United States Patent [19]

Hoyt

[11] Patent Number: 4,517,809

[45] Date of Patent: May 21, 1985

[54] ENERGY CONSERVATION SYSTEM FOR HEATING AND COOLING OF STRUCTURES

[76] Inventor: Wilber S. Hoyt, 406 Beverly Dr., Lafayette, La. 70503

[21] Appl. No.: 428,144

[22] Filed: Sep. 29, 1982

Related U.S. Application Data

[62] Division of Ser. No. 207,120, Nov. 17, 1980, abandoned.

[51] Int. Cl.[3] ..... F25B 39/04

[52] U.S. Cl. ..... 62/183; 62/455; 251/DIG. 2

[58] Field of Search ..... 62/181, 183, 428, 452, 62/454, 455, 410, 411, 412, 429; 165/62; 251/DIG. 2

[56] References Cited

U.S. PATENT DOCUMENTS

| | | | |
|---|---|---|---|
| 2,401,560 | 6/1946 | Graham et al. | 62/262 X |
| 2,892,324 | 6/1959 | Quick | 62/183 |
| 3,500,655 | 3/1970 | Lyons | 62/183 |
| 3,897,773 | 8/1975 | Burt et al. | 126/285 R |
| 4,071,080 | 1/1978 | Bridgers | 62/412 X |
| 4,175,403 | 11/1979 | Lunde | 62/324 |

FOREIGN PATENT DOCUMENTS

| | | | |
|---|---|---|---|
| 2705060 | 8/1978 | Fed. Rep. of Germany | 251/DIG. 2 |

*Primary Examiner*—Harry Tanner
*Attorney, Agent, or Firm*—Harold J. Delhommer

[57] ABSTRACT

The disclosed invention is an energy conservation system for heating and ventilating structures, particularly buildings with large refrigeration units such as convenience stores, grocery stores and restaurants. The system employs a plurality of manifold assemblies in conjunction with existing air conditioning and heating units to control air flow to recover heat from external heat exchangers of refrigeration units or provide interior ventilation with exterior air. The manifold assemblies preferably employ either a flexible damper gate sliding along tracks on a pivoted gate damper to control air flow.

4 Claims, 12 Drawing Figures

ENERGY CONSERVATION SYSTEM FOR HEATING AND COOLING OF STRUCTURES

This is a division of application Ser. No. 207,120, filed 11/17/80, now abandoned.

TECHNICAL FIELD OF THE INVENTION

The present invention relates to the field of an energy conservation system for ventilating and heating a structure by utilizing a plurality of manifold assemblies to control air flow in the heating and cooling of the buildings. In particular, the invention pertains to the selective use of damper means to direct air flow for cooling and removing heat from the interior of a building and to reclaim heat from a source of heat such as a heat exchanger of a refrigeration unit. The present invention has great value when employed in grocery store and restaurant buildings which have large refrigeration units.

PRIOR ART

Although the prior art contains a plethora of devices for heating, cooling and ventilating buildings, it does not disclose the instant system employing manifold assemblies having controllable dampers for heat reclaiming and cooling, particularly for use in conjunction with condenser heat exchangers of refrigeration units. Many dampers for ventilation purposes employ louvers with multiple slats which are unreliable in operation over lengthy service periods and which often fail to seal. Additionally, such louvered damper systems may malfunction in a closed position which can result in the burn out of machinery from air starvation.

U.S. Pat. Nos. 3,785,434 and 4,175,403 disclose two different types of heat pumps for use in commercial or residential heating or cooling which recover heat by employing dampers and heat exchangers. Two heat exchangers are utilized in U.S. Pat. No. 4,175,403 to recycle return air from the interior of the building with recaptured heat from the air exhausted out of the building. Not only is the cost of the U.S. Pat. No. 4,175,403 system significant, but it also fails to utilize the same apparatus for cooling the building.

A dual conduit air conditioning and heating system is disclosed in U.S. Pat. No. 3,967,780 wherein a portion of returned air is passed through dampers and heat exchangers before being recirculated back into the building. A dual conduit system for mixing air masses of varying temperatures which is an expensive and wasteful method of heating and cooling buildings is employed which does not provide the advantages of outside air ventilation or the recovery of heat.

A movable gate damper apparatus is disclosed in U.S. Pat. No. 3,897,773 to direct exhaust gases from gas turbines in electric generating plants to exhaust stacks. The reference, however, fails to disclose employing a damper of sufficient size in connection with the heating and cooling of buildings. Additionally, the disclosed damper is not operated automatically when arranged in series, and particularly in combination with heat exchangers of refrigeration units as does the present invention.

Another type of heat recovery device employing a simple heat exchanger is illustrated in a 1978 brochure of Des Champs Laboratories, Inc. of East Hanover, N.J. The brochure advertises a heat exchanger product trademarked "Z-DUCT". The Z-DUCT heat exchanger apparatus transfers heat between fresh intake air and exhaust air of air conditioning and heating systems and does not recover the waste heat energy from refrigeration units.

SUMMARY OF THE INVENTION

The energy conservation system disclosed in the present application offers significant advantages in heating and cooling commercial and residential buildings, particularly those structures with refrigeration units having condenser heat exchangers located exteriorly of the structure. In the heat recovery mode of the preferred embodiment, the apparatus enables circulation of interior air through the condenser heat exchangers and then recirculates this heated air back into the structure. In the ventilation mode, the apparatus provides for the flow of exterior air into the structure while interior air flows to the outside of the building. Interior air is discharged from the building at a greater rate than exterior air is drawn into the building to create and maintain an interior air pressure lower than atmospheric pressure. The lower interior air pressure increases evaporative cooling from the human body.

The apparatus employs two or more manifold assemblies each having a damper means for selecting one or more air flow passages and a thermostat sensor for automatically controlling the operating position of the damper as the temperature changes. The damper may be either a flexible gate which slides along channels within the manifold assembly or a hinged gate which pivots along one edge.

DETAILED DESCRIPTION

Figure 1:
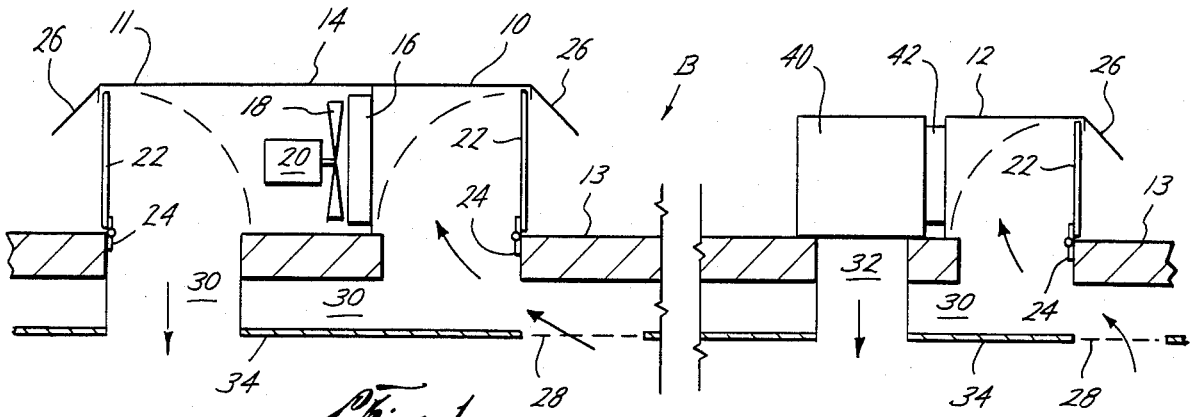
FIG. 1 is a cross-sectional view illustrating an embodiment of the system invention in its heat reclaim mode of operation where interior air is recycled back to the building's interior after passing in contact with the refrigeration unit heat exchanger.
Figure 2:
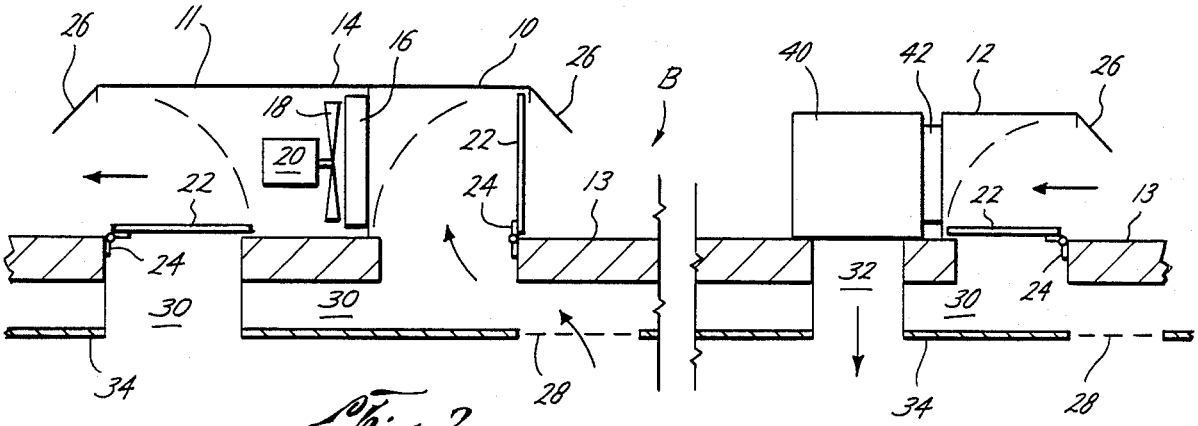
FIG. 2 is a view similar to FIG. 1 illustrating the cooling mode of operation where exterior air is directed into the building by the usual air conditioning unit and the refrigeration unit fan circulates cooling air out of the building.
Figure 3:
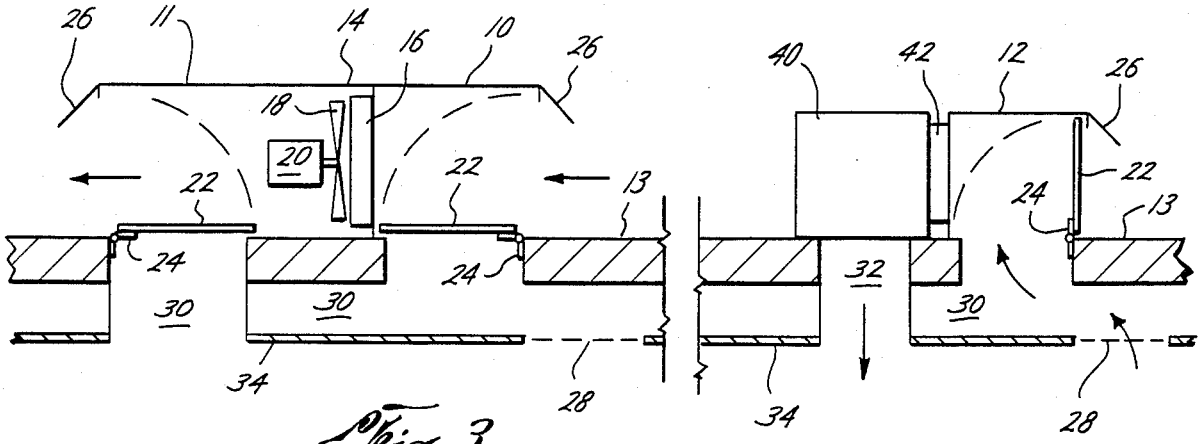
FIG. 3 is also a view similar to FIG. 1 illustrating the mode of operation of the present invention on hot days when the outside air is used to cool the refrigeration unit heat exchanger.

In FIGS. 1, 2 and 3, ventilation air flow control manifold assemblies 10, 11 and 12 in accordance with the present invention are shown mounted on a building roof 13 with assemblies 10 and 11 located on opposite sides of a refrigeration unit condenser heat exchanger 16 with an outer manifold housing 14 enclosing at least a portion of the heat exchanger 16, its air circulation or blower fan 18 and fan motor 20. Damper valves or gates 22 are mounted on pivot hinges 24 within the intake and exhaust manifolds 10 and 11 to control air flow in the manifolds in the usual manner. A conventional thermostat controller unit (not shown) is arranged to automatically control movement of the pivoted gate damper means 22 to direct the flow of air. Weather hoods 26 are attached to the manifold assemblies 10 and 11 to prevent precipitation or other undesired matter from entering the manifolds 10 and 11 in the usual manner. The third manifold assembly 12 is mounted with a conventional air conditioning and heating unit 40 by means of air duct or conduit 42. If the air conditioning and heating units employed are separate, a fourth manifold assembly may be needed unless the two units share a common exterior air intake.

The heat recovery cycle or mode of operation illustrated in FIG. 1 is employed when the outside or building exterior ambient temperature falls below a preselected level, normally about 13° C. The preselected temperature level at fast food restaurants, for instance, may not require additional heating until the outside or exterior temperature falls to about 8°–10° C. When operated in the mode illustrated, the air circulation fan 18 of the heat exchanger 16 induces a draft of interior air from the building B through grating 28 into the building ductwork 30 connected to the intake manifold 10 and refrigeration unit condenser heat exchanger 16. The normally wasted heat from the refrigeration unit heat exchanger 16 is then recirculated into the building through manifold ductwork 30 in the usual manner. During this mode of operation, the damper gate 22 of the third assembly 12 is positioned to exclude exterior air from the building B. Interior air travels through grating 28 in the ceiling 34 and through the ventilating ductwork 30 into the third manifold assembly 12. This air then contacts the conventional heat exchanger 40 for heating the air before returning to the building interior by ducting 32.

Figure 6:
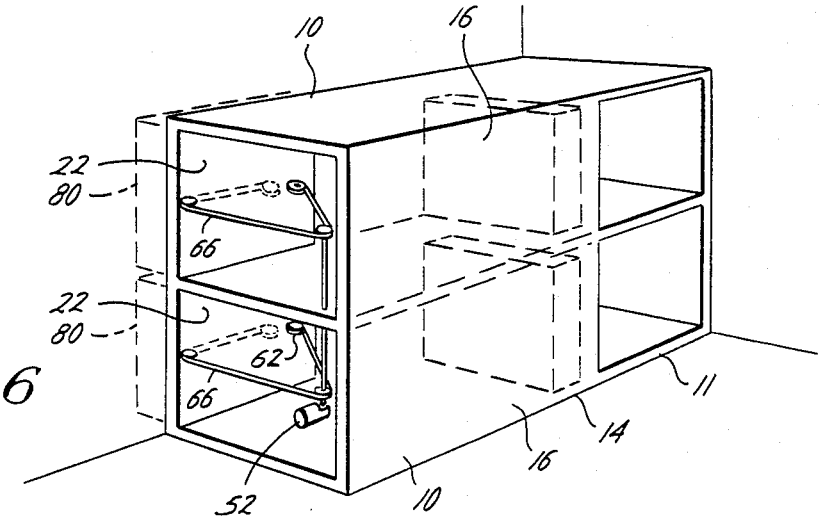
FIG. 6 is a perspective view illustrating adjacent manifold assemblies operated by a common shaft, control and motor.

Although FIG. 1 illustrates roof mounted apparatus, the present invention is not limited to any specific location. The apparatus may be employed wherever it is convenient to remotely locate the refrigeration unit heat exchangers for cooling and condensing the refrigerant. For example, the apparatus may be installed at ground level within the building B with air circulation ductwork extending through the building side wall as illustrated in FIG. 6.

The ventilation operating cycle or mode, which is normally actuated when the ambient temperature air is from about 13° C. to about 30° C., is illustrated in FIG. 2. The damper gate 22 of the air conditioning unit manifold apparatus 12 is moved to close exhaust communication with interior ductwork 30. This enables exterior or outside air to flow into the manifold 12 and building B by operation of the air conditioning unit 42. The fan 18 mounted with the condenser heat exchanger 16 draws the building interior air through the intake manifold assembly 10 into contact with the heat exchanger 16. The damper gate 22 of the exhaust manifold 11 is positioned to direct the heated air to atmosphere and prevent it being recirculated back into the structure.

It is desirable to control the speed of the fan 18 and the fan of the air conditioning unit 42 and the resulting volume of air pushed by each fan to create a slight vacuum within the building. Interior air should be discharged from the building at a greater rate than exterior air is drawn into the building to create an interior air pressure lower than atmospheric pressure. The lower interior air pressure increases evaporative cooling from the human body, thereby permitting building occupants to comfortably withstand higher temperatures.

When actually tested in several convenience stores, it was discovered that the interior environment was quite comfortable at temperatures up to 30° C. with the ventilation mode. The air circulation within the structure can be further enhanced by the use of other apparatus well known in the art such as ceiling fans, partitions, baffles and the like. Air flow should be directed to work and customer waiting areas at a speed of 200–300 feet per minute.

The economics of the conservation system can be further enhanced by replacement of the standard air conditioning fan with a three-speed fan for greater control over ventilation. The fan of the air conditioning unit 40 may be controlled by a conventional thermostat, not shown, which will disengage the compressor of the air conditioning unit 40, to further save energy. A humidistat may also be provided with an electrical control to switch the conservation system from the cooling cycle shown in FIG. 2 to the air conditioning cycle or mode regardless of the exterior and interior temperatures when the relative humidity of the building's interior rises to an uncomfortable level.

The energy conservation system is normally operated in the air conditioning cycle illustrated in FIG. 3 when the ambient temperature is above 30° C. The damper gates 22 of the first and second manifold assemblies 10 and 11 close off circulation with the interior of the building B. Exterior air is then circulated through the heat exchanger 16 for its cooling by means of the fan 18 and returned to atmosphere. The third manifold assembly 12 is also closed to exterior air as in the heat reclaim cycle of FIG. 1. The air conditioning unit 40 then operates in the usual manner of drawing interior air from ductwork 30, cooling it and discharging or recirculating back into the building B through ductwork 30. Although FIGS. 1–3 are illustrated with a pivoted damper gate 22, a flexible damper gate which slides along tracks in the manifold, as illustrated in FIGS. 9–12 may be employed.

Figure 4:
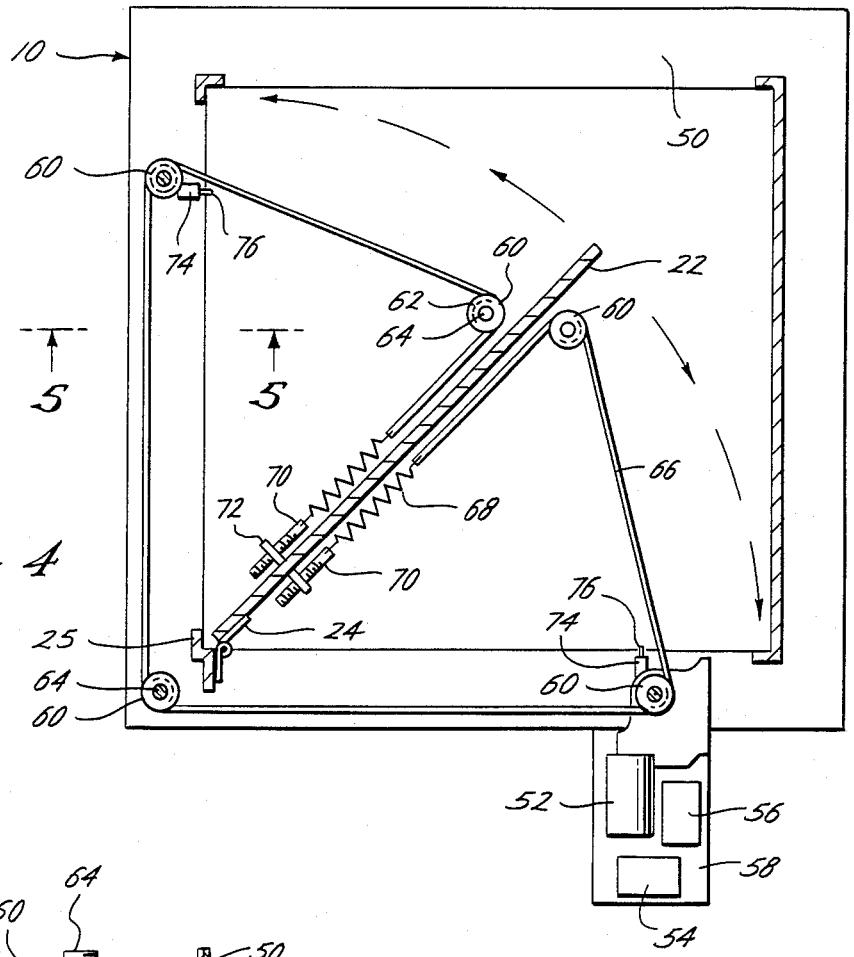
FIG. 4 is a cross-sectional view of a manifold assembly having a swinging gate damper.
Figure 5:
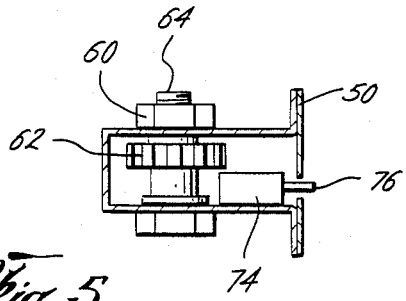
FIG. 5 is a view taken along line 5—5 of FIG. 4.

One embodiment of the damper gate 22 of the manifold assembly 10 is shown in expanded detail in FIG. 4. The manifold frame 50 is preferably constructed of plastic or metal and insulated with fiberglass, but other materials of construction may be used. The damper gate 22 is pivotally mounted to the support plate 25 of the manifold frame 50 by a hinge 24 in the usual manner. An electric motor 52 and associated electronic control units 54 and 56 are mounted on support plate 58 formed by the frame 50. The electronic control boxes or units 54 and 56 are well known to those versed in the art and include a thermostat, humidistat and appropriate electrical relays or solid state electronics to automatically operate the motor 52 as exterior and interior temperature and humidity change.

Operation of the motor 52 turns a sprocket capstan 60 which moves the damper gate 22 by means of a connecting drive linkage 66. The drive linkage 66 is connected around capstans 60 mounted on axles 64 with each end of the connecting drive linkage 66 attached to the damper gate 22 by means of springs 68, bolts 70 and mounting plates 72. A one-fifteenth horsepower motor 52 having a 1787 to 1 ratio worm gear reduction output shaft with 450 inch pounds of torque has been found to perform satisfactorily for the damper gate 22. The output shaft of the motor 52 turns at 9 rpm which slowly moves the damper gate 22. The motor 52 is stopped by contact of the gate 22 with limit proximity switch 74 having a conventional contact plunger 76 as best illustrated in FIG. 6. The switch 74 enables proper adjustment of the tension of spring 68 to maintain the gate 22 in the closed position during a strong wind. A rubber gasket may be mounted on the gate 22 to form an air tight seal in a closed position. Additionally, a suitable filter screen or other means for removing foreign particles from the exterior air may be mounted on the manifold 10.

FIG. 6 illustrates a plurality of four manifold assemblies installed adjacent a building corner surrounding two interior refrigeration condenser heat exchangers 16. The assemblies 10 are stacked in a vertical relationship to enable both damper gates to be operated by a single motor 52. Suitable ductwork 80 is shown in phantom leading to the exterior of the building; but the system is illustrated in the heat recovery mode with each damper gate 22 positioned to close off exterior air.

Figure 7:
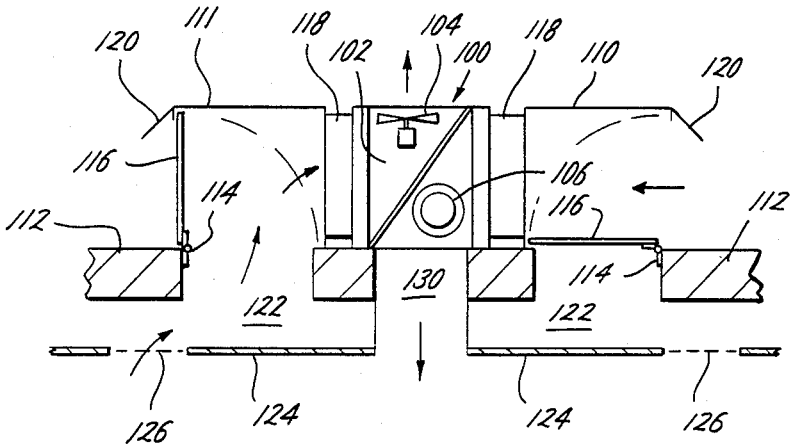
FIG. 7 is a cross-sectional view of an alternate embodiment of the present invention illustrating interior air circulating through the refrigeration unit heat exchanger and discharging exteriorly of the structure.
Figure 8:
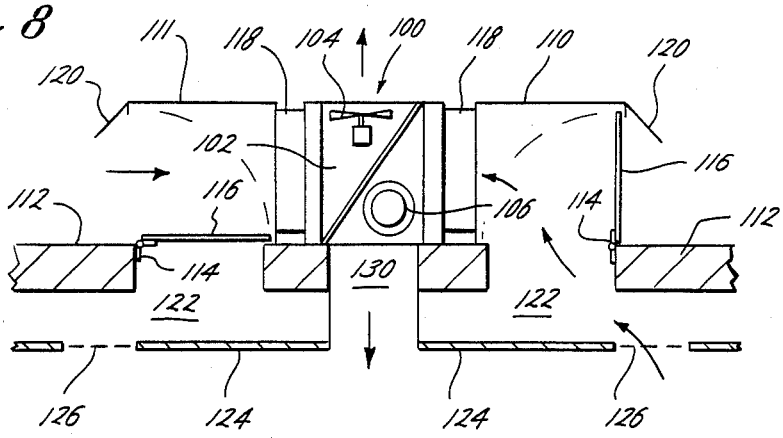
FIG. 8 is a view similar to FIG. 7 illustrating the operation of the alternate embodiment with exterior air cooling the refrigeration unit heat exchanger.

An alternate embodiment of the present invention suitable for use in building structures without remotely located refrigeration condenser heat exchanger units is illustrated in FIGS. 7 and 8. Although only employing two roof mounted manifolds, 110 and 111, which use similar parts to that of FIGS. 1–3 with the reference characters increased by 100, this embodiment still offers substantial energy savings when additional cooling is desired. FIG. 7 illustrates the system used in conjunction with a conventional air conditioning unit 100 in a cooling cycle, which would normally be actuated when the ambient temperature range is about 13° C. to about 30° C. In this cycle, exterior air is drawn into the manifold 110 by the blower fan 106 of the conventional air conditioning unit 100. The fan 106 discharges the exterior air into the building structure through interior ductwork 130. Interior air is exhausted through ceiling grating 126, interior ductwork 122 and the condensing coil 102 by the fan 104 of the air conditioning unit 100. Suitable electrical automatic controls similar to those mentioned earlier control operation of the system and permit operation of the air conditioning fan 106 while the compressor is disengaged, saving considerable energy.

FIG. 8 illustrates this embodiment with standard air conditioning unit operation. The manifold 110 is operated to exclude outside air by the damper gate 116. The air conditioning unit 100 draws interior air through manifold 110 and recycles it through ductwork 130 after removing its heat and humidity. The damper gate 116 of the manifold 110 seals off the interior and allows exterior air to cool the refrigerant in refrigeration unit condenser heat exchanger 102.

Figure 9:
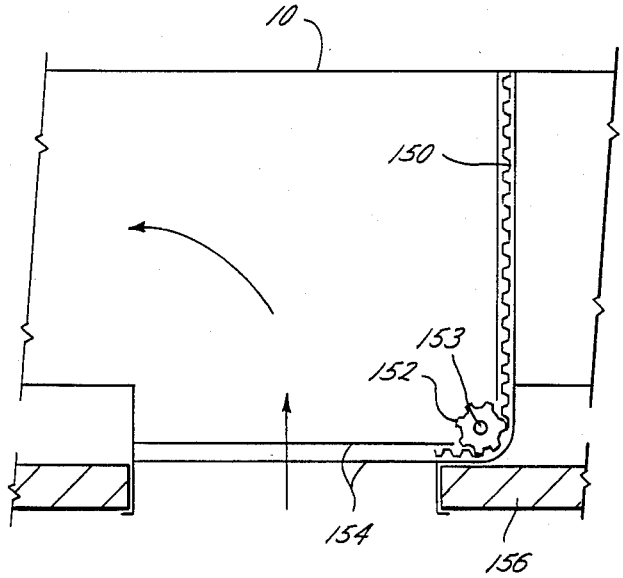
FIG. 9 is a cross-sectional view illustrating a manifold with flexible gate damper.
Figure 10:
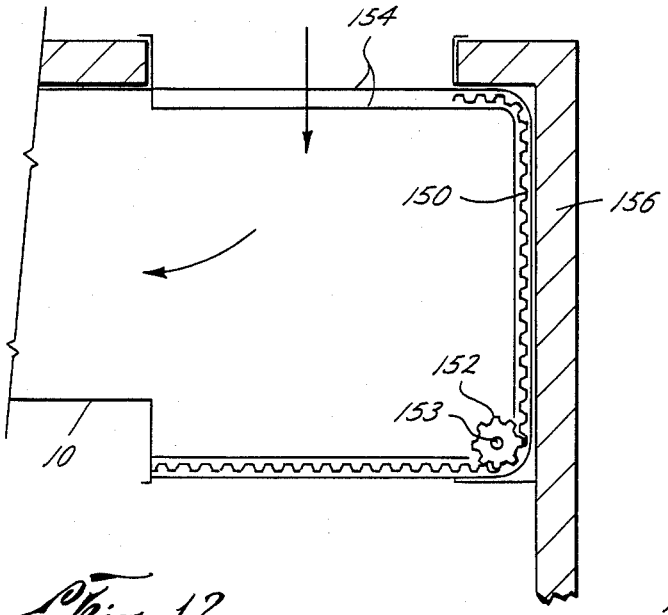
FIG. 10 is a cross-sectional view further illustrating the flexible gate damper embodiment.

FIGS. 9–12 illustrate a preferred embodiment of the manifold assembly which is identical in purpose to the hinged gate of FIG. 4. In the embodiment of FIG. 9, a flexible gate comprised of multiple interlocking segments 158 of the gate 150 sliding along channels or tracks 154 is used instead of the swinging gate to control air flows. Gear means 152 rotates on axle 153 and engages indentations in the flexible gate 150 for moving the gate 150. The flexible gate may be made from plastic or metal, but it is preferably made of aluminum and an extruded plastic such as polyvinylchloride. FIG. 10 depicts a slightly different version to be used where the configuration of the ceiling or wall 156 requires the placement of two gates directly opposite to each other. The flexible gate 150 is simply extended to accommodate such an arrangement as operation remains the same.

Figure 11:
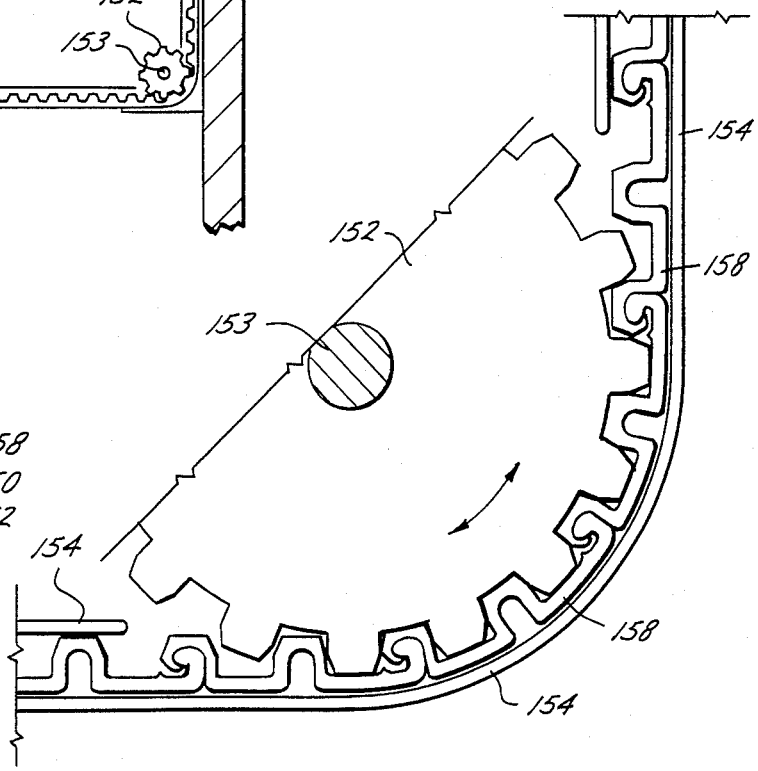
FIG. 11 is a view illustrating the details of engagement of the gear means with the multiple interlocking sections of the flexible gate.
Figure 12:
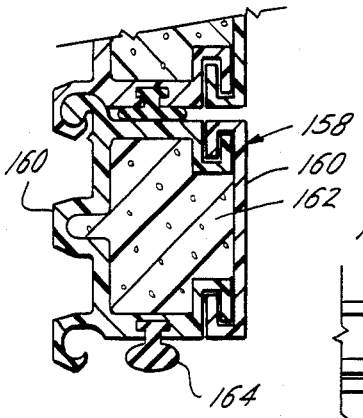
FIG. 12 is a view illustrating the details of a single section of a flexible gate damper.

A cutaway of multiple interlocking sections 158 is shown in FIG. 11. The interlocking sections 158 are designed in such a way so as to allow movement of each section 158 around the axle 153 mounted gears 152. FIG. 12 illustrates an enlarged cross-sectional view of an interlocking section 150 with an outer case 160 made of plastic or metal surrounding or enclosing an insulating material core 162. Suitable seals 164 may be provided between interlocking sections 158 to prevent passage of air.

The economics afforded in energy costs can be quite substantial. In two convenience stores in Niagara Falls, N.Y., where the conservation system has been tested, the savings in electricity costs per summer month averaged $200 and $250 per store. The monthly savings during the winter months of January to March when heat was reclaimed averaged $170 for one store and $250 for the other. These savings were based on electricity costing five cents per kilowatt, which will likely increase in the future. It is estimated that fast food restaurants with their unusually high interior heat generation could save from $400 to $500 per month in air conditioning costs. About 20% to about 60% of the energy needed to heat grocery stores in this country could be saved by the practice of this invention, depending upon the geographic location of the store and the amount of refrigeration equipment present.

A further advantage of the conservation system is that it no longer becomes necessary to winterize exterior heat exchangers for refrigeration units in cold climates. Because the condenser coils for most refrigeration units are placed outside of buildings, it is necessary to spend about $400 or more for winterizing the system. Suction pressure control can be utilized on this system as the condenser coils are in the heated area. Suction pressure control is desirable to enable defrosting of the refrigeration coils inside the refrigeration system and prevent the freezing up of the refrigeration system and the need for a defrost clock on medium temperature equipment. Winterizing such controls usually involves cycling the condenser fan with the thermostat, employing a bypass valve to reduce the flow of refrigerant to the condenser, lowering the pressure of the refrigerant or any other step needed to make the suction controls function properly. Winterizing becomes unnecessary with the present invention.

Both the swinging gate and flexible gate damper embodiments offer an additional advantage in machinery protection over the multiple louvered damper systems of the prior art. Such louvered damper systems may malfunction in a closed position which can result in the burn out of machinery from air starvation. It is impossible for this to occur with the damper embodiments of the present invention as there is always an open intake in the manifold assemblies to provide a source of air in the event of damper malfunction.

It should be noted that the foregoing disclosure and description of the invention is illustrative and explanatory thereof, and various changes in the size, shape and materials as well as in the details of the illustrated construction may be made without exceeding the scope and spirit of the invention.

I claim:

1. An energy conservation system for ventilating and heating of a structure substantially enclosing a refrigeration unit having a heat exchanger remotely disposed from the refrigeration unit, comprising:

a housing enclosing at least a portion of a heat exchanger;

an intake manifold communicating with said housing for providing a path for air to flow into the housing for contact with the heat exchanger, said intake manifold having a first inlet communicating with the air exteriorly of the structure and a second inlet communicating with the air interiorly of the structure;

a first damper means mounted with said intake manifold for selecting at least one inlet of air of said intake manifold for flow into said housing;

an exhaust manifold communicating with said housing for providing a path for air to flow from the heat exchanger, said exhaust manifold having a first outlet communicating with the air exteriorly of the structure and a second outlet communicating with the air interiorly of the structure;

a second damper means mounted with said exhaust manifold for selecting at least one outlet of the exhaust manifold for flow of effluent air out of the exhaust manifold, said second damper means selecting said second outlet to recover heat from said heat exchanger for warming the interior air of the structure when desired;

said first and second damper means include flexible gates comprising multiple interlocking sections which slide along channels within the housing and gear means for moving the flexible gates to select between alternate air passages, said interlocking sections having indentations for engagement with the gear means;

means in said housing for flowing air from said intake manifold into heat transfer contact with the heat exchanger and on into said exhaust manifold; and means for supplying exterior air into the structure when said first damper means is selecting flow of air from said second inlet and said second damper means is selecting said first outlet.

2. The apparatus of claim 1, wherein the means for supplying exterior air comprises a blower.

3. The apparatus of claim 2, additionally comprising:

a third manifold communicating with the blower, said third manifold having a third inlet communicating with the air exteriorly of the structure and a fourth inlet communicating with the air interiorly of the structure; and a third damper means mounted with said third manifold for selecting at least one inlet of the third manifold for flow of air to the blower.

4. The apparatus of claim 1, wherein the damper means are controlled by a thermostat.

* * * * *